US005370805A

United States Patent [19]

Smrcka et al.

[11] Patent Number: 5,370,805

[45] Date of Patent: Dec. 6, 1994

[54] CHLORINE-FREE DIESEL ENGINE LUBRICATING COMPOSITION

[75] Inventors: Nancy K. Smrcka, Point Richmond; Wesley A. Middleton, Concord, both of Calif.

[73] Assignee: Chevron Research and Technology Company, a Division of Chevron U.S.A. Inc., San Francisco, Calif.

[21] Appl. No.: 154,653

[22] Filed: Nov. 18, 1993

[51] Int. Cl.[5] ..... C10M 141/06; C10M 159/16

[52] U.S. Cl. ..... 252/42.7; 252/51.5 A

[58] Field of Search ..... 252/42.7, 39, 51.5 A

[56] References Cited

U.S. PATENT DOCUMENTS

| | | | |
|---|---|---|---|
| 3,178,368 | 4/1965 | Hanneman | 252/33.4 |
| 3,801,507 | 4/1974 | Hendrickson et al. | 252/42 F |
| 3,909,428 | 9/1975 | DeVries et al. | 252/42.7 |
| 3,912,707 | 10/1975 | Abbott et al. | 252/42.7 |
| 3,932,289 | 1/1976 | King et al. | 252/42.7 |
| 4,131,551 | 12/1978 | Thompson et al. | 252/33 |
| 4,169,799 | 10/1979 | Sung et al. | 252/42.7 |
| 4,171,269 | 10/1979 | Sung et al. | 252/33 |
| 4,171,270 | 10/1979 | Sung et al. | 252/42.7 |
| 4,178,259 | 12/1979 | King | 252/42.7 |
| 4,278,553 | 7/1981 | Sung et al. | 252/50 |
| 4,282,107 | 8/1981 | Zoleski et al. | 252/42.7 |
| 4,285,823 | 8/1981 | Sung et al. | 252/50 |
| 4,608,184 | 8/1986 | Chang | 252/42.7 |
| 4,612,132 | 9/1986 | Wollenberg et al. | 252/51.5 A |
| 4,734,211 | 3/1988 | Kennedy | 252/51.5 A |
| 4,820,431 | 4/1989 | Kennedy | 252/56 R |
| 4,849,118 | 7/1989 | Stauffer et al. | 252/47 |
| 4,871,465 | 10/1989 | Hutchison | 252/47 |
| 4,927,551 | 5/1990 | Erdman et al. | 252/42.7 |
| 4,948,523 | 8/1990 | Hutchison et al. | 252/47 |

*Primary Examiner*—Jacqueline V. Howard

*Attorney, Agent, or Firm*—E. A. Schaal; W. K. Turner

[57] ABSTRACT

A railway diesel engine lubricating composition is essentially free of zinc dithiophosphate wear inhibitors and chlorinated inhibitors. This composition has an oil of lubricating viscosity; a noncarbonated sulfurized calcium alkyl phenate, a carbonated sulfurized calcium alkyl phenate, a calcium Mannich alkyl phenate, and an ethylene carbonate modified polybutene bis-succinimide. The noncarbonated sulfurized calcium alkyl phenate has a sulfur to metal ratio of between 1.1:1 and 2:1, the alkyl group of that phenate has from 8 to 35 carbon atoms, and the alkalinity value of that phenate is from 40 to 200 mg. KOH/gram. The noncarbonated sulfurized metal alkyl phenate is prepared by reacting a tetrapropylene phenol, sulfur, and a calcium base.

11 Claims, No Drawings

CHLORINE-FREE DIESEL ENGINE LUBRICATING COMPOSITION

The present invention relates to a chlorine-free lubricating engine oil composition used in medium speed engines having silver bearings. In a further aspect, the invention relates to the protection of silver bearing parts in internal combustion engines.

BACKGROUND OF THE INVENTION

A large number of railroad and tugboat diesel engines use silver or silver-plated bearings. As a result, the lubricating oil, which typically requires oxidation stability, wear control, deposit control and alkalinity, must also give acceptable silver wear and corrosion performance. While these properties can be achieved by the use of lubricating oil additives known in the art, many of these additives cause unacceptable corrosion and wear to silver engine parts. Also, typical bearing protection additives, which are effective to protect other material bearing surfaces like brass, copper-lead, bronze, aluminum, are ineffective to protect silver bearing parts or are deleterious to silver (e.g., zinc dithiophosphate).

At present, silver protection is largely provided by the use of lubricants containing chlorinated paraffins or other chlorinated additives. Examples of chlorinated additives used to provide silver protection are described in U.S. Pat. Nos. 4,131,551; 4,169,799; and 4,171,269. However, there is a concern that the use of halogenated additives might cause an environmental problem when disposing of the used oil and oil filters. Thus, there is a need for lubricants which provide silver protection without the inclusion of chlorinated additives.

In view of this need the art has already developed certain chlorine-free or reduced chlorine silver corrosion inhibitor-containing lubricants. For example, U.S. Pat. No 4,734,211 discloses a marine and railroad diesel engine lubricating oil composition containing certain polyhydroxy esters as silver wear inhibitors. These patents also disclose lubricating oil compositions containing a mixture of these polyhydroxy esters and chlorinated paraffins. U.S. Pat. No. 4,820,431 discloses a method for reducing silver wear in marine and railway diesel engines using similar lubricating oil compositions. Unfortunately, these polyhydroxy esters are expensive, they are incompatible with some oils, and they can cause copper-lead corrosion.

U.S. Pat. No. 4,171,270 discloses lubricating oil compositions containing a sulfurized overbased calcium alkylphenolate and a sulfurized naphthenic base oil-containing composition having a sulfur content of from 1 percent to 6 percent by weight. Unfortunately, the sulfurized naphthenic base oil can cause oxidation and viscosity increases in newly required standardized oxidation tests.

U.S. Pat. No. 4,282,107 discloses a diesel crankcase lubricant composition containing a non-$CO_2$ blown 2:1 calcium hydroxide overbased calcium salt of a sulfurized alkylphenolate, an alkenyl succinimide and a pour point depressant in a mineral oil base. These compositions are also thought to have silver wear and corrosion properties, but the described product is expensive, can have high lead weight loss, and can have high oxidative base loss.

U.S. Pat. No. 4,871,465 discloses lubricating oils containing as a silver protectant (a) a sulfurized olefin, sulfurized fatty acids, sulfurized hydroxyaromatics, 1,3,4-thiadiazoles, and dithiocarbamates and (b) the reaction product of a saturated aliphatic dicarboxylic acid with an optionally substituted amino guanidine. Unfortunately, these protectants are expensive, they are incompatible with some oils, and they can cause copper-lead corrosion.

U.S. Pat. No. 4,948,523 discloses a chlorine-free silver protective lubricant composition, using the reaction product of a carboxylic acid and an amine. Unfortunately, these protectants are also expensive, they are incompatible with some oils, and they can cause copper-lead corrosion.

Other organic compounds have also been disclosed as providing silver protection. U.S. Pat. No. 4,278,553 discloses a railway diesel engine lubricant containing a silver corrosion inhibitor comprising a benzotriazole compound present in concentrations from about 0.5 to 2.0 wt % and U.S. Pat. No. 4,285,823 discloses a diesel lubricant composition containing a silver corrosion inhibiting compound of an N-substituted 5-amino-1H-tetrazole. Unfortunately, these protectants are also expensive, they are incompatible with some oils, and they can cause copper-lead corrosion.

Therefore there is a need for a silver corrosion inhibitor that is inexpensive, compatible with most oils, and does not cause copper-lead corrosion.

SUMMARY OF THE INVENTION

The present invention provides a diesel engine lubricating composition that is essentially free of zinc dithiophospnate and chlorinated inhibitors. Besides having an oil of lubricating viscosity, this lubricating composition has two components. The first component is a minor effective amount of a noncarbonated sulfurized metal alkyl phenate having a sulfur to metal ratio of between 1:1 and 4:1. The second component is a minor effective amount of a carbonated sulfurized metal alkyl phenate, such as a carbonated sulfurized calcium alkyl phenate.

The preferred noncarbonated sulfurized metal alkyl phenate is a calcium phenate having a sulfur to metal ratio of between 1.1:1 and 2:1, having from 8 to 35 carbon atoms In its alkyl group, and having an alkalinity value of from 40 to 200 mg. KOH/gram. This phenate can be prepared by reacting an alkylated phenol, sulfur, and an alkaline earth metal base. Preferably, this reaction is performed in the presence of a mutual solvent. Preferably, the alkylated phenol is tetrapropylene phenol, and the alkaline earth metal base is calcium oxide, calcium hydroxide, or a combination thereof.

In addition to the carbonated and noncarbonated sulfurized metal alkyl phenates described above, the lubricating composition can contain a metal Mannich alkyl phenate, such as a calcium Mannich alkyl phenate. Preferably, the lubricating composition also has an ethylene carbonate modified polybutene bis-succinimide.

DESCRIPTION OF THE INVENTION

In its broadest aspect, the present invention involves a diesel engine lubricating composition that is essentially free of zinc dithiophosphate wear inhibitors and is essentially free of chlorinated inhibitors. This composition has a major proportion of an oil of lubricating viscosity and minor effective amounts of a noncarbonated sulfurized metal alkyl phenate and a carbonated sulfurized metal alkyl phenate. The noncarbonated sulfurized metal alkyl phenate has a sulfur to metal ratio of between 1:1 and 4:1.

In one useful embodiment, the present invention is an engine oil composition comprising a base oil, noncarbonated sulfurized metal alkyl phenate, a carbonated sulfurized metal alkyl phenate, a metal Mannich alkyl phenate, an ashless dispersant, and a molybdenum-containing inhibitor. No zinc dithiophosphate or chlorinated inhibitor is present in the formulation.

BASE OIL

Suitable lubricating oils that can be used to prepare lubricating oil compositions of this invention are oils of lubricating viscosity derived from petroleum or synthetic sources. The oils can be paraffinic, naphthenic, synthetic esters, polyolefins, or combinations thereof.

Preferably, the oil of lubricating viscosity is a lubricating oil, fractions of a mineral oil such as petroleum, either naphthenic, paraffinic or as mixed naphthenic/-paraffinic base, unrefined, acid-refined, hydrotreated or solvent refined as required for the particular lubricating need. In addition, synthetic oils such as ester lubricating oils and polyalphaolefins, or dialkylaromatics, as well as mixtures thereof with mineral oil meeting the viscosity requirements for a particular application either with or without viscosity index improvers may also be used provided the above compound is soluble therein. The oil of lubricating viscosity preferably will have a viscosity in the range from about 10 to 850 cSt at 40° C. and will be selected or blended depending on the end use of the additive. Suitable oils include low, medium, high and very high viscosity index lubricating oils.

NONCARBONATED SULFURIZED METAL ALKYL PHENATE

An essential component of the present invention is a noncarbonated sulfurized metal alkyl phenate that has a sulfur to metal ratio of between 1:1 and 4:1. Noncarbonated sulfurized metal alkyl phenates are disclosed by Hendrickson et al. in U.S. Pat. No. 3,801,507, entitled "Sulfurized Metal Phenates," which is hereby incorporated by reference for all purposes.

A major advantage of using a noncarbonated sulfurized metal alkyl phenate to improve the wear properties of the oil toward silver is that a noncarbonated sulfurized metal alkyl phenate is multifunctional. Besides reducing silver wear, a noncarbonated sulfurized metal alkyl phenate reduces oxidation, improves soot dispersancy, and adds basicity to the oil.

The soot dispersancy of noncarbonated sulfurized metal alkyl phenate is surprisingly good. Poor soot dispersancy leads to high viscosity increases in diesel oils, which is a very serious performance problem. Generally people reduce the viscosity of oils from poor soot dispersancy by adding more dispersant or changing to a more polar dispersant. Detergents or sulfurized compounds are not associated with soot dispersancy. Surprisingly, we have found that noncarbonated sulfurized alkyl calcium phenates have lower viscosity increases with addition of soot. Carbonated sulfurized alkyl calcium phenates, salicylates, sulfonates, or Mannich phenates do not show such performance. It requires at least 4 TBN of noncarbonated sulfurized metal alkyl phenate to show an effect. Above 4 TBN, the performance levels off.

Preferably, the noncarbonated sulfurized metal alkyl phenate has a sulfur to metal ratio of between 1.1:1 and 2:1. Preferably, the metal of the phenate is calcium, the alkyl group of the phenate has from 8 to 35 carbon atoms, and the alkalinity value of the phenate is from 40 to 200 mg. KOH/gram.

As disclosed in U.S. Pat. No. 3,801,507, the phenate can be prepared by reacting an alkylated phenol, sulfur, and an alkaline earth metal base in the presence of a mutual solvent.

The alkylated phenols useful in this invention are of the formula:

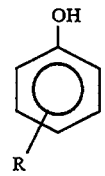

where R may be a straight chain or a branched-chained alkyl group having from 8 to 35 carbon atoms, preferably from 10 to 30 carbon atoms. The R group may be present on any of the sites around the phenolic ring, i.e., ortho, meta, or para. Preferably, the R groups will be predominantly meta or para. A particularly preferred alkylated phenol is tetrapropylene phenol.

Several of the alkaline earth metal hydroxides or oxides may be employed in this invent:on. Such compounds include calcium hydroxide, calcium oxide, barium hydroxide, and barium oxides. Combinations of the oxides and hydroxides of different alkaline earth metals may be used. Preferably, the alkaline earth metal base is calcium oxide, calcium hydroxide, or a combination thereof.

The mutual solvent can comprise any stable organic liquid which has appreciable solubility for both the alkaline earth metal base and the alkylated phenol and the sulfurized intermediate. Such mutual solvents include dihydric alcohols.

CARBONATED SULFURIZED METAL ALKYL PHENATE

The noncarbonated sulfurized metal alkyl phenate is used in conjunction with a carbonated sulfurized metal alkyl phenate, such as a carbonated sulfurized calcium alkyl phenate. Such a carbonated sulfurized calcium alkyl phenate is disclosed by Walter W. Hanneman in U.S. Pat. No. 3,178,368, entitled "Process For Basic Sulfurized Metal Phenates," which is hereby incorporated by reference for all purposes.

Carbonated sulfurized calcium alkyl phenates are inexpensive and are a good source of basicity. Unfortunately, carbonated sulfurized calcium alkyl phenates have an adverse effect on silver wear performance and CMOT (Caterpillar Micro Oxidation Test) performance.

We have discovered that the use of noncarbonated sulfurized calcium alkyl phenates and carbonated sulfurized calcium alkyl phenates together gives an inexpensive solution that is a good source of basicity while actually helping silver wear performance and CMOT performance.

METAL MANNICH ALKYL PHENATE DETERGENT

A metal Mannich alkyl phenate can be used in conjunction with the noncarbonated sulfurized metal alkyl phenate and carbonated sulfurized metal alkyl phenate. Preferably, the metal is calcium. This metal Mannich alkyl phenate can be prepared by reacting an alkyl phenol having from 8 to 35 carbon atoms in the alkyl group, a primary amine, and an aldehyde to form a Mannich base, and then reacting the Mannich base with an alkaline earth metal base in the presence of a mutual solvent. Preferably, the alkyl phenol is tetrapropylene phenol and the mutual solvent is a diol.

ASHLESS DISPERSANT

Examples of the ashless dispersant used in the invention includes succinimides, succinic esters and benzylamines, each of which has an alkyl or alkenyl group of a molecular weight of from 700 to 3,000. The ashless dispersant is generally incorporated into an engine oil in an amount of from 0.5 to 15 wt % in the engine oil.

Preferably, the ashless dispersant is an ethylene carbonate modified polybutene bis-succinimide. Such a bis-succinimide is disclosed by Wollenberg et al. in U.S. Pat. No. 4,612,132, entitled "Modified Succinimides," which is hereby incorporated by reference for all purposes.

The lubricating composition of the invention may contain various additional additives other than those described above. Examples of such additional additives include corrosion inhibitors, rust inhibitors, friction modifiers, anti-foaming agents and pour point depressants. In addition to these additives, Viscosity Index (Vi) improvers, other oxidation inhibitors (hindered phenol), anti-wear agents( sulfurized olefin) and multifunctional additives may be employed in combination.

EXAMPLES

The invention will be further illustrated by following examples, which set forth particularly advantageous method embodiments. While the examples are provided to illustrate the present invention, they are not intended to limit it.

EXAMPLE 1

NONCARBONATED SULFURIZED CALCIUM ALKYL PHENATE

A noncarbonated sulfurized calcium alkyl phenate was prepared according to the procedures disclosed in U.S. Pat. No. 3,801,507. This phenate was prepared by reacting a propylene tetramer derived alkylphenol and lime in a mutual solvent, then sulfurizing the resulting reaction product. The noncarbonated sulfurized calcium alkyl phenate had a sulfur to calcium ratio of between 1.1:1 and 2:1, and an alkalinity value of between 40 to 200 mg. KOH/gram. Example 1 contained 4.25 wt % calcium, 5.5 wt % sulfur, with a TBN of 114.

EXAMPLE 2

CALCIUM MANNICH PHENATE

A reaction vessel equipped with a mechanical stirrer was charged with propylene tetramer derived alkylphenol, diluent oil, and paraformaldehyde. Next, monomethylamine was added. The reaction was heated until complete, then lime was charged to the reaction vessel, and the vessel was heated with the removal of water. Ethylene glycol was added, and heating was continued at an elevated temperature. Once the reaction was completed, the volatiles were removed, leaving a reaction product. Example 2 contained 2.5 wt % calcium, 1.60 wt % nitrogen, with a TBN of 135.

EXAMPLE 3

ASHLESS DISPERSANT

An ethylene carbonate treated, 1300 molecular weight polybutene bis-succinimide dispersant was prepared according to the procedures disclosed in U.S. Pat. No. 4,612,132. Example 3 contained 1.2 wt % nitrogen, with a TBN of 12.

EXAMPLE 4

ENGINE OIL OF PRESENT INVENTION (17 TBN)

A lubricating oil of the described invention containing no chlorinated compounds and no zinc-containing compounds was blended as a 17 TBN engine oil as described below.

| Component | wt % |
|---|---|
| Example 1 (Noncarbonated Sulfurized Calcium Alkyl Phenate) | 2.8 |
| Carbonated Sulfurized Calcium Alkyl Phenate | 4.1 |
| Example 2 (Calcium Mannich Phenate) | 2.3 |
| Example 3 (Ashless Dispersant) | 4.5 |
| Calcium Sulfonate | 1.1 |
| Molybdenum Inhibitor | 0.2 |
| VI Improver | 4.0 |
| Base Oil | Remainder |

EXAMPLE 5

ENGINE OIL OF PRESENT INVENTION (13 TBN)

A lubricating oil of the described Example 4 (17 TBN Engine Oil), was blended as a 13 TBN engine oil. The formulation contained a lower level of additives however with the same ratio used in Example 4. The 13 TBN formulation was:

| Component | wt % |
|---|---|
| Example 1 (Noncarbonated Sulfurized Calcium Alkyl Phenate) | 2.1 |
| Carbonated Sulfurized Calcium Alkyl Phenate | 3.0 |
| Example 2 (Calcium Mannich Phenate) | 1.7 |
| Example 3 (Ashless Dispersant) | 3.3 |
| Calcium Sulfonate | 0.8 |
| Molybdenum Inhibitor | 0.15 |
| VI Improver | 4.0 |
| Base Oil | Remainder |

EXAMPLE 6

SCREENING EXAMPLE

Candidate detergents were added to the following formulation to bring the finished blend to 17 TBN:

| Component | wt % |
|---|---|
| Example 3 (Ashless Dispersant) | 3.3 |
| Calcium Sulfonate | 1.1 |
| VI Improver | 4.0 |

-continued

| Component | wt % |
|---|---|
| Base Oil | Remainder |

EXAMPLE 7

SILVER PROTECTION PERFORMANCE

Example 4 (17 TBN Engine Oil) was engine tested for its ability to protect silver. The engine test, which is well known in the art, is a diesel engine test called the EMD 2-567C, commonly known as the "2 holer test". The engine test assesses the distress of a silver plated wrist pin after 25 hours of operation.

In the 2 holer test, the normally protected silver bushing of the wrist pin bushing assembly is replaced with an unprotected silver bushing. (Normally the bushing is protected with a thin lead flashing to prevent silver removal from corrosion and high friction during break-in.) Removal of the lead flashing greatly increases the test severity. The test engine used in this evaluation has a D-1 type assembly. The D-1 configuration uses three chrome plated and one ferrite-filled caste iron compression ring above the piston pin with one hooked scraper-type oil control ring and one ventilated caste iron ring below the pin. The nominal compression ratio is 20:1.

The engine is kept in newly built condition by periodic replacement of the liners, piston, rings carriers, thrust washer, cam bearing, rods, rod bearings, main bearings, and reconditioned heads with new valves and rebuilt injectors.

For each silver wear test, the engine is thoroughly cleaned with a commercial petroleum-based solvent and the wrist pin replaced with a new piston pin and unprotected (i.e., unleaded) silver plated pin bearings. Prior to conducting the silver wear test, the engine is given a full 9 hour and 20 minute EMD type break-in. Following the break-in the crankcase and air boxes are inspected for signs of bearing failure before the test phase is initiated. While under test, the engine is held at 835 rpm, 91±1.0 lbs./hr. fuel rate and 6.8 inches of Hg air box pressure by a distributed digital process control computer. The water and oil inlet temperatures are controlled at 180°±2° F. and 210°±2° F., respectively. The crankcase and all oil lines are flushed with 2.5 test oil, and the crankcase is charged to its full capacity of 45 U.S. gallons. The fuel for the test contains 0.1% sulfur and the cetane number is a nominal 47–50 No. 2 diesel. Each test is conducted using identical test conditions. The piston pin bearings were weighted before and after the test. The piston pin diameters and carrier clearances were taken before and after the test.

At the conclusion of the test, the pin bearings are removed and rated according to the EMD distress demerit procedure which measures and assigns demerits based on the amount of silver which has been displaced from the bearings into the oil grooves. An average of 30 or less demerits with neither of the two bearing having 40 or more demerits is considered a passing result.

Evaluation of the formulation described by Example 4 (17 TBN Engine Oil containing Examples 1 and 2) in the full-term EMD 2 holer test is as follows:

| Example 4 (17 TBN Engine Oil) | | |
|---|---|---|
| Bearing Right Demerits | 8 | Pass |

-continued

| Example 4 (17 TBN Engine Oil) | | |
|---|---|---|
| Bearing Left Demerits | 7 | Pass |

Unexpectedly, Example 4, without chlorine containing compounds, passed the EMD 2 holer test. The extremely low number of demerits for this VI Improver containing oil is also unexpected.

Upon further investigation, removing Example 1 (Noncarbonated Sulfurized Calcium Alkyl Phenate) from Example 4 (17 TBN Engine Oil) gave a severe fail in the EMD 2 holer test during break-in:

| Example 4 Minus Example 1 | | |
|---|---|---|
| Bearing Right Demerits | 8 | |
| Bearing Left Demerits | 440 | Fail |

Removing Example 2 (Calcium Mannich Phenate) from Example 4 (17 TBN Engine Oil) formulation gave an improved (but still failing) result in a full-term EMD 2 holer test:

| Example 4 Minus Example 2 | | |
|---|---|---|
| Bearing Right Demerits | 138 | Fail |
| Bearing Left Demerits | 9 | |

Example 5 (13 TBN Engine Oil) was engine tested for its ability to protect against silver wear in the full-term 2 holer test. The test results are:

| Example 5 | | |
|---|---|---|
| Bearing Right Demerits | 11 | Pass |
| Bearing Left Demerits | 13 | Pass |

This also gave a passing result.

EXAMPLE 8

SOOT DISPERSANCY

In this example, numerous detergents were evaluated for performance in a bench test for soot dispersancy. The bench test provides a rapid means of determining an oil's ability to control viscosity due to soot. The test indirectly evaluates the ability of the oil to disperse soot and keep particle size small. In this test, carbon black soot is added to the finished oil. The soot is well mixed in the oil and then degassed in a vacuum oven. The viscosity of the oil is measured before and after the addition of the soot. Oils with poor dispersancy have high viscosity increase due to the agglomeration of the carbon black in the oil. Oils with good dispersancy have low viscosity increase.

Several metal detergents were blended in a finished oil as described in Example 6 (Screening Example).

The results are as follows:

| Detergent | Average % Vis Inc |
|---|---|
| Example 1 (Noncarbonated Sulfurized Calcium Alkyl Phenate) | 48 |
| Carbonated Sulfurized Calcium Alkyl Phenate | 71 |
| Calcium Salicylate | 64 |
| Example 2 | 71 |

-continued

| Detergent | Average % Vis Inc |
|---|---|
| (Calcium Mannich Phenate) | |
| Calcium Sulfonate | 78 |
| None | 71 |

In this test, differences greater than 5 are statistically different at the 95% confidence level.

Example 1 (noncarbonated sulfurized calcium alkyl phenate) gave significantly better performance than the other detergents.

Ashless dispersants were also blended in Example 6 (Screening Example) at 3.3 wt %. The dispersants showed the following performance:

| Dispersant | Average % Vis Inc |
|---|---|
| Succinate | 120 |
| Example 3 (Ashless Dispersant) | 62 |
| Mono succinimide | 95 |
| Bis succinimide | 86 |
| No dispersant | 298 |

EXAMPLE 9

COPPER-LEAD CORROSION

In this example the formulations identified in Example 4 and 5 were evaluated for performance in engines having copper-lead bearings by the Labeco L-38 Test Method, ASTM D5119-90.

The Labeco L-38 Test Method, ASTM D5119-90, is designed to evaluate crankcase lubricating oils for resistance to oxidation stability, corrosion, sludge and varnish when subjected to high temperature operation. When multigrade oils are tested, it also evaluates shear stability of the test oil.

The procedure involves the operation of the single cylinder CLR oil evaluation engine under constant speed, air-fuel ratio and fuel flow conditions for 40 hours, subsequent to a break-in period of 4.5 hours. Prior to each run, the engine is thoroughly cleaned, pertinent measurements of engine parts are taken, and new piston, piston rings and copper-lead connecting rod bearing inserts are installed.

Bearing weight loss data is obtained at 40 hours.

The key engine operating conditions for this evaluation are as follows:

| | |
|---|---|
| Duration | 40 hours |
| Speed | 3150 ± 25 rpm |
| Load | Adjusted to provide proper fuel flow at specific air-fuel ratio |
| Fuel Flow | 4.75 ± 0.25 lbs/hr |
| Air-Fuel Ratio | 14.0 ± 0.5 |
| Jacket-Out Temperature | 200° F. |
| Difference between Jacket-In and Jacket-Out Temperatures | 10 ± 2° F. |
| Gallery Oil Temperatures | 290° F. |

At the conclusion of the run, the engine is disassembled and the performance of the oil is judged by the following: 1 ) a visual examination of the engine for deposits; 2) by the weight loss of the copper-lead bearing; 3) and by comparing the periodic oil sample analysis with the new oil analysis.

To further stress the oil the test can be run longer to 80 hours.

An 80 hour result is considered a very extreme test of copper-lead corrosion performance.

The results of this test are given in below. As can be seen from the test results, Example 4 and 5 passed this test easily at the normal 40 hours. However to severely stress the oil for copper-lead corrosion performance Example 4 was also tested for another additional 40 hour for a total of 80 hours. The test results at 80 hours were also passing.

| | Copper-Lead Bearing Weight Loss, mg | |
|---|---|---|
| Oil | 40 hrs | 80 hrs |
| Example 4 | 17.3 | 19.1 |
| Example 5 | 22.6 | |
| Limit | 50 max | |

EXAMPLE 10

DETERGENT SYNERGY

A factorial matrix was executed to look at possible synergy between the Example 1 and Example 2 on viscosity increase. The formulation in this matrix contained: dispersant, calcium sulfonate and carbonated sulfurized calcium alkyl phenate. Only the dosage of Example 1 and Example 2 varied. Example 2 varied between 0 and 2.3 wt % and Example 1 varied between 0 and 2.8 wt %. The full factorial matrix, which consisted of four oils, included:

| | Dosage, wt % | |
|---|---|---|
| Test | Example 1 | Example 2 |
| 1 | 0 | 0 |
| 2 | 2.8 | 0 |
| 3 | 0 | 2.3 |
| 4 | 2.8 | 2.3 |

All four oils were; tested in a modified Burlington Northern oxidation test which is used to judge the acceptability of an oil. The modified Burlington Northern test is a very severe oxidation test. The test measures the oxidative stability of the oil (% viscosity increase and DIR- Differential Infrared at 5.8 micron for oxidation). The test method involves stirring 100 grams of oil which contains 0.5 grams of oil soluble copper/iron catalyst at a temperature of 345° F. for 48 hours. The oil and catalyst are stirred in 600 ml beakers with aluminum stirrers which have four blades which are 1½ inches high by 1 inch wide, welded to a ¼ inch aluminum rod that is approximately 9½ inches long. The beakers are kept at 345°±1° F. by a thermostatically controlled oil bath. The; viscosity of the test oil is measured before and after the 48 hours. The greater the viscosity increase the greater the oxidative deterioration. In addition the amount of oxidation is determined by infrared analysis which measures the peak height of the test oil at 5.8 microns after the 48 hours to the oil before test. The peak height at 5.8 microns divided by the path length of the test sample cell determines the amount of oxidation (carbonyl peak). The higher the number the greater the oxidation.

The four oils, as described above, were tested in the modified Burlington Northern test. The results are as follows:

| Test | Avg. % Vis Inc. | Avg. DIR abs/cm @ 5.8 microns |
|---|---|---|
| 1 | 257.5 | 178 |
| 2 | 166.5 | 154 |
| 3 | 201.0 | 166 |
| 4 | 56.5 | 86 |

The data was analyzed with ANOVA (Analysis of variance) and Student T test to determine the size of the effect and significance. It is important to note that the repeatability of the bench test was extremely good to see small differences at high confidence levels. Both Example 1 and Example 2 had a significant effect at the 95% confidence level for both viscosity increase and oxidation measured by DIR. Also there was a surprising synergy between Example 1 and Example 2 on both viscosity increase and oxidation at the 95% confidence level.

While the present invention has been described with reference to specific embodiments, this application is intended to cover those various changes and substitutions that may be made by those skilled in the art without departing from the spirit and scope of the appended claims.

What is claimed is:

1. A diesel engine lubricating composition comprising:

(a) a major proportion of an oil of lubricating viscosity, (b) a minor amount of a noncarbonated sulfurized metal alkyl phenate having a sulfur to metal ratio of between 1:1 and 4:1, and (c) a minor amount of a carbonated sulfurized metal alkyl phenate, wherein the lubricating composition is essentially free of zinc dithiophosphate wear inhibitors and chlorinated inhibitors.

2. A lubricating composition according to claim 1 wherein the noncarbonated sulfurized metal alkyl phenate has a sulfur to metal ratio of between 1.1:1 and 2:1.

3. A lubricating composition according to claim 1 wherein the metal of both the noncarbonated sulfurized metal alkyl phenate and the carbonated sulfurized metal alkyl phenate is calcium.

4. A lubricating composition according to claim 1 wherein the alkyl group of the noncarbonated sulfurized metal alkyl phenate has from 8 to 35 carbon atoms.

5. A lubricating composition according to claim 1 wherein the alkalinity value of the noncarbonated sulfurized metal alkyl phenate is from 40 to 200 mg. KOH/gram.

6. A lubricating composition according to claim 1 wherein the noncarbonated sulfurized metal alkyl phenate is prepared by reacting an alkyl phenol, sulfur, and an alkaline earth metal base.

7. A lubricating composition according to claim 6 wherein the alkyl phenol is tetrapropylene phenol, and wherein the alkaline earth metal base is calcium oxide, calcium hydroxide, or a combination thereof.

8. A diesel engine lubricating composition comprising:

(a) a major proportion of an oil of lubricating viscosity, (b) a minor effective amount of a noncarbonated sulfurized metal alkyl phenate having a sulfur to metal ratio of between 1:1 and 4:1, (c) a minor amount of a carbonated sulfurized metal alkyl phenate, and (d) a minor amount of a metal Mannich alkyl phenate, wherein the lubricating composition is essentially free of zinc dithiophosphate wear inhibitors and chlorinated inhibitors.

9. A lubricating composition according to claim 8 wherein the metal of the metal Mannich alkyl phenate is calcium.

10. A diesel engine lubricating composition comprising:

(a) a major proportion of an oil of lubricating viscosity;

(b) a minor amount of a noncarbonated sulfurized calcium alkyl phenate having a sulfur to metal ratio of between 1.1:1 and 2:1, and having from 8 to 35 carbon atoms in the alkyl group;

(c) a minor amount of a carbonated sulfurized calcium alkyl phenate;

(d) a minor amount of a calcium Mannich alkyl phenate;

(e) a minor effective amount of an ethylene carbonate polybutene bis-succinimide; and (f) a minor amount of a molybdenum-containing inhibitor;

wherein the lubricating composition is essentially free of zinc dithiophosphate wear inhibitors and chlorinated inhibitors.

11. A lubricating composition according to claim 10 wherein the noncarbonated sulfurized calcium alkyl phenate is prepared by reacting tetrapropylene phenol, sulfur, and a calcium base, wherein the calcium base is calcium oxide, calcium hydroxide, or a combination thereof.

* * * * *